US005671878A

United States Patent [19]

Kawasaki

[11] Patent Number: 5,671,878

[45] Date of Patent: Sep. 30, 1997

[54] CERAMIC-MADE GUIDE FOR ROLLING LINE

[75] Inventor: Keiji Kawasaki, Chiryu, Japan

[73] Assignee: NGK Insulators, Ltd., Nagoya, Japan

[21] Appl. No.: 674,993

[22] Filed: Jul. 3, 1996

Related U.S. Application Data

[63] Continuation of Ser. No. 361,671, Dec. 22, 1994, abandoned.

[30] Foreign Application Priority Data

Dec. 28, 1993 [JP] Japan ..... 5-334525

[51] Int. Cl.[6] ..... B65H 23/04; G03B 1/48

[52] U.S. Cl. ..... 226/196; 140/147; 72/274

[58] Field of Search ..... 226/196; 140/147; 72/79, 274, 467

[56] References Cited

U.S. PATENT DOCUMENTS 4,038,858 8/1977 DeZuba ..... 72/274

4,177,843 12/1979 Sarver ..... 140/147

5,150,197 9/1992 Hamburgen ..... 357/80

5,372,883 12/1994 Shores ..... 428/323

5,406,825 4/1995 Horie et al. ..... 72/358

FOREIGN PATENT DOCUMENTS 1 427 882 9/1969 Germany .

*Primary Examiner*—Daniel P. Stodola

*Assistant Examiner*—Emmanuel M. Marcelo

*Attorney, Agent, or Firm*—Kubovcik & Kubovcik

[57] ABSTRACT

A ceramic guide for a rolling line, used for wire rod transfer in a rolling line, which has a cylindrical contour and a throughhole for wire rod transfer. The throughhole includes a tapered hole and a straight hole of constant diameter, the tapered hole being provided at the wire rod inlet side of the guide. This ceramic guide, when used in a rolling line, is less liable to cause seizure with a wire rod and has higher durability.

7 Claims, 2 Drawing Sheets

Fig. 1
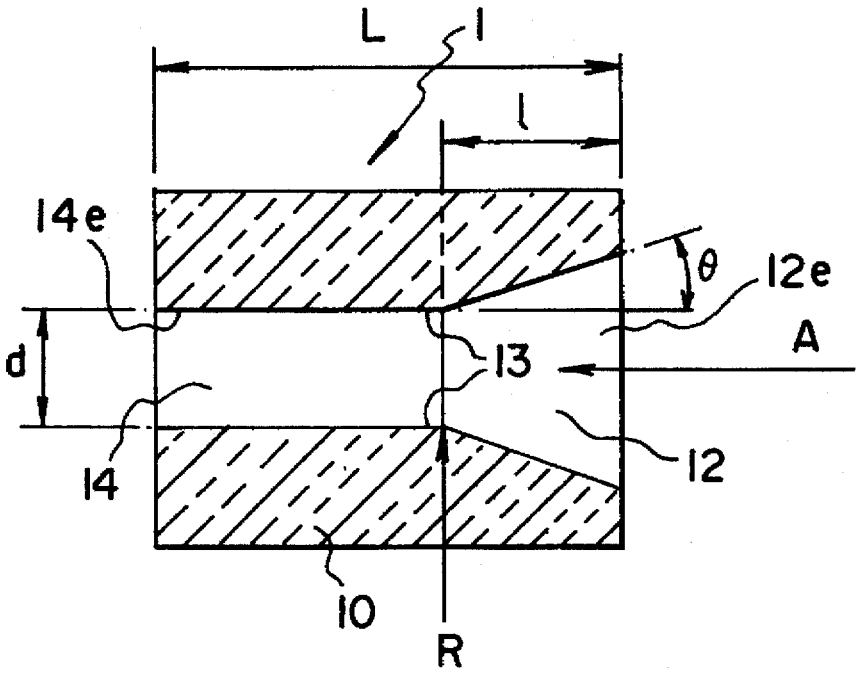
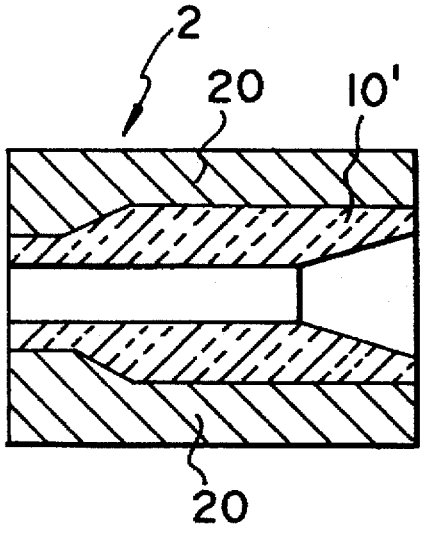
Fig. 2

CERAMIC-MADE GUIDE FOR ROLLING LINE

This application is a continuation of application Ser. No. 08/361,671 filed Dec. 22, 1994, now abandoned.

BACKGROUND OF THE INVENTION (1) Field of the Invention

The present invention relates to a ceramic guide used in a rolling line for transfer of a wire rod, etc. More particularly, the present invention relates to a ceramic guide produced in a rolling line between a rolling mill and a cooling trough and/or between the cooling trough and a coil winding machine.

(2) Description of the Prior Art

In hot- or cold-rolling lines for a wire rod, etc. (hereinafter referred to simply as "wire rod") made of a metal such as iron, copper or iron alloy, there are provided guides for wire rod transfer, between a rolling mill and a cooling trough and between the cooling trough and a coil winding machine. As such guides for wire rod transfer, there have widely been used pipes, rollers, or combinations of said pipes and said rollers, all made of a metal such as tool steel, heat-resistant steel or the like.

With these conventional metallic guides, however, there occurs seizure between the guide and a wire rod owing to the friction, etc. because the temperature of the wire rod transferred is typically as high as about 1,000° C. and the feeding speed of the wire rod is as large as about 40–100 m/sec, which allows the wire rod to have flaws and consequently a reduced product value.

Further, the seizure has deteriorated and damaged the guides per se and has shortened their durabilities.

SUMMARY OF THE INVENTION

In view of the above problems of the prior art, the object of the present invention is to provide a guide for rolling line which is less liable to cause seizure with a wire rod in a rolling line and which has high durability.

In order to solve the above problems, the present inventor made a study and found out that the above problems can be solved by using a guide which is made of a ceramic and whose throughhole is formed in a particular shape. The finding has led to the completion of the present invention.

The present invention provides a ceramic guide for a rolling line, used for wire rod transfer in the rolling line, which has a cylindrical contour and a throughhole for wire rod transfer consisting of a tapered hole and a straight hole of constant diameter, the tapered hole being provided at the wire rod inlet side of the guide.

The guide of the present invention has a throughhole through which a wire rod is to be passed. The throughhole consists of (1) a tapered hole formed at the wire rod inlet side of the guide and (2) a straight hole of constant diameter which is the remaining portion of the throughhole.

With this throughhole structure, a wire rod is properly guided into the tapered hole even when the wire rod is slightly swinging or the moving direction of the wire rod deviates slightly from the axial direction of the throughhole, at the time of introducing the wire rod into the throughhole. Further, with the throughhole structure, the guide itself is hardly damaged by the swinging of the wire rod.

BRIEF DESCRIPTION OF THE DRAWINGS

FIG. 1 is a sectional view showing an example of the present ceramic guide for a rolling line.

FIG. 2 is a sectional view showing other example of the present ceramic guide for a rolling line.

DETAILED DESCRIPTION OF THE INVENTION

The guide for a rolling line, of the present invention is described in detail below.

The present guide for rolling line is a ceramic guide having a throughhole. A wire rod made of a metal (e.g. iron, copper, or iron alloy) is passed through the throughhole and thereby is guided properly.

The throughhole consists of (1) a tapered hole and (2) a straight hole of constant diameter. In a rolling process, a wire rod enters the guide at the tapered hole and leaves the guide via the straight hole. The tapered hole is tapered from the wire rod inlet of the guide toward the outlet of the guide, and the straight hole has a constant diameter throughout the entire length.

The diameter of the straight hole is not particularly restricted and can be varied as desired, but it is typically 5–30 mm. The taper angle of the tapered hole is preferably about 5°–45°. When the angle is smaller than 5°, the wire rod, when entering the guide with the front end swinging, may collide with the guide and damage it. When the angle is larger than 45°, the transitional portion of the throughhole between the tapered hole and the straight hole has an acute angle, which may invite the damaging of the wire rod and/or the transitional portion.

The relationship between the length (l) of the tapered hole (the length in the axial direction of the throughhole) and the diameter (d) of the straight hole is preferably $l=0.2\ d\sim3.0\ d$, more preferably $l=0.5\ d\sim2.0\ d$. When $l<0.2\ d$, the resulting guide has a small effect on the prevention of wire rod swinging. When $l>3.0\ d$, the straight hole has a small length, making it impossible to control the direction of the wire rod.

The ratio L/l of the length (L) of the guide in the axial direction to the length (l) of the tapered hole is preferably 2–10, more preferably 2–5. When L/l is smaller than 2, the length of the straight hole is too small, making it impossible to control the direction of the wire rod. When L/l is larger than 10, the length of the straight hole is too large, making difficult the production of the guide.

In the throughhole, the transitional portion between the tapered hole and the straight hole is preferably formed in a smooth and gentle shape. It is because, without the smooth and gentle shape, the transitional portion tends to be damaged when a wire rod, which is swinging, is introduced into the throughhole.

Hence, the transitional portion from the tapered hole to the straight hole is preferably formed so as to have a radius (R) of curvature of 0.5 mm or more, more preferably 1.0 mm or more.

Figure 4:
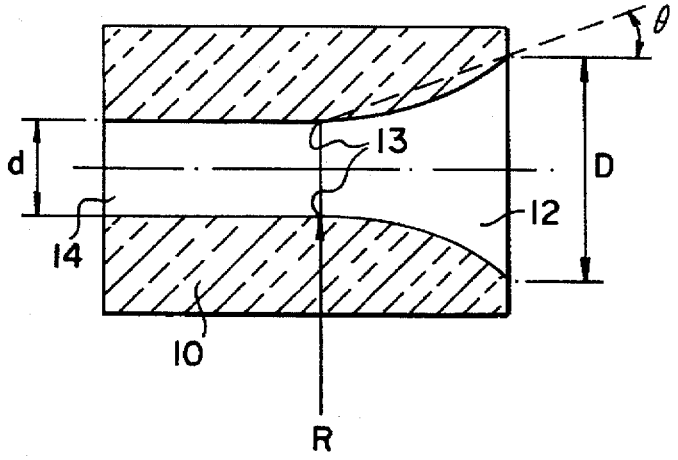
FIG. 4 is a sectional view showing a shape of the tapered hole of the present ceramic guide for a rolling line.
Figure 5:
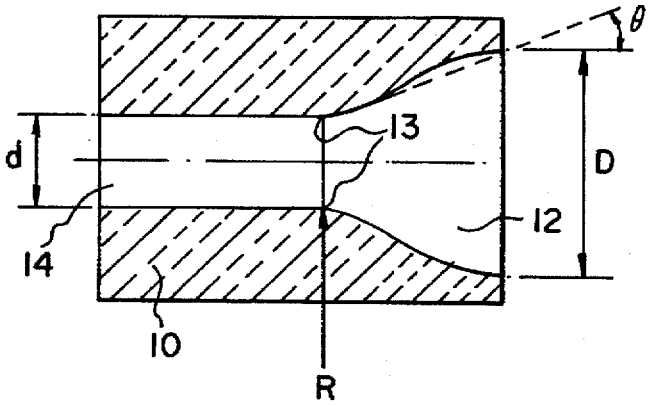
FIG. 5 is a sectional view showing another shape of the tapered hole of the present ceramic guide for a rolling line.

The tapered hole includes not only a tapered hole as shown in FIG. 1, having a constant taper angle but also a tapered hole as shown in FIG. 4 or 5, having changing taper angles. The tapered hole also includes a tapered hole consisting of a portion of constant taper angle and a portion of changing taper angles.

When the tapered hole of the present guide contains a portion of changing taper angles, the taper angle θ of this tapered hole is defined as an angle formed by (A) the axis of the guide and (B) a straight line (as shown in FIG. 4 or 5 as a broken line) passing the circumference of the inlet of the straight hole and the circumference of the inlet of the tapered hole.

Next, description is made on the ceramic constituting the present guide.

The ceramic can be exemplified by a ceramic having a Vickers hardness of 1,100–1,600, preferably 1,200–1,400 at room temperature and 800–1,400, preferably 900–1,200 at 800° C. and a four-point bending strength of 500–1,000 MPa at room temperature to 800° C. Specific examples thereof are a sintered silicon nitride material, a sialon, etc.

Any ceramic without such properties is unsuitable because the resulting guide undergoes high abrasion and is damaged or because the guide is too hard and damages a steel rod.

With respect to the circumference of the throughhole, i.e. the inner surface of the guide, it is not advisable to grind the as-fired surface of the guide. Preferably, a guide having a throughhole is molded using a die or produced by other method in a desired shape and then firing is conducted but no treatment is applied to the inner surface of the guide after firing. The reason for this (no grinding treatment to inner as-fired surface) is as follows. Since the inner as-fired surface has a delicate undulation, as compared with the inner surface after grinding, and moreover contains the sintering aid components (e.g. Al and Mg) in a small amount, the as-fired surface is less liable to give rise to a reaction during its sliding with a steel rod and can effectively prevent seizure, etc. Needless to say, no grinding further provides a lower cost.

When the inner surface of the guide has a large surface roughness, the wire rod to be passed through the guide may be damaged. Therefore, the surface roughness of the inner surface of the guide is preferably Rmax (maximum height) =10 μm or less, more preferably Rmax=1–5 μm.

When the inner surface of the guide is an as-fired surface, not subjected to any grinding and its surface roughness does not satisfy the above range, the surface roughness of the inner as-fired surface is preferably controlled at the step of surface finish in mold or at the step of processing before firing.

Another example of the present guide includes a guide for a rolling line comprising the above-mentioned guide as a main part and a metallic housing surrounding the main part.

The kind of the metal used for housing can be appropriately varied depending upon, for example, the conditions employed in rolling, but is preferably a tool steel, a stainless steel, a heat-resistant steel or the like.

The metallic housing is mounted on the main part of the guide and then the resulting guide is fixed by bolting or the like via the metallic housing, whereby the guide can easily be provided at a desired site of a rolling line.

In one metallic housing may be accommodated a plurality of guide main parts. Particularly when guides are provided between a cooling trough and a coil winding machine, it is preferable to accommodate a plurality of guide main parts in one metallic housing having a contour of a curved cylinder.

In the present invention, the metallic housing is not an essential member. Instead, it is possible to allow the guide main part to have a projection or the like and, by the use of the projection or the like, provide the guide at a desired site of a rolling line. This approach, however, takes a longer time for guide production and reduces the efficiency of such production. Therefore, mounting of a metallic guide on a guide main part is preferred.

There is no particular restriction as to the method for mounting the metallic housing on the guide main part. Suitable methods include free fit, shrinkage fit, press fit, etc. A fixing material such as adhesive or the like may be used, but free fit or the like is preferable in view of the cost and labor of mounting. It is possible to allow the circumference of the guide main part to have a tapered portion or a shape of different levels to use it as a stopper for the metallic housing, whereby the metallic housing can be mounted more easily.

In the free fit, etc., the fitting tolerance of the metallic housing is preferably set to be F to H which are specified by JIS B 0401, and the fitting tolerance of the guide main part is preferably set to be e to g which are specified also in the same standard. The above setting of fitting tolerance is made because the guide used in a rolling line is often subjected to high temperatures in the actual operation and the possible detachment of the housing must be avoided.

Then, description is made on an example of the method for fitting the present guide in a rolling line.

In principle, the present guide for a rolling line is provided in a rolling line between a rolling mill and cooling trough and/or between the cooling trough and a coil winding machine.

When the guide is provided between the rolling mill and the cooling trough, it is provided so that the axial direction of the guide main part agrees with the transfer direction of a wire rod to be transferred. In this case, the number of the guides provided may be one or more than one per one transfer passage of the wire rod. When more than one guide (a plurality of guides) is provided, they are arranged like a chain.

The size of the present guide for a rolling line has no particular restriction. However, when the guide is provided in a method as mentioned above and the diameter of the wire rod to be passed therethrough is about 20 mm or smaller, the wall thickness of the guide main part is preferably about 5–20 mm and its length (L) in the guide axial direction is preferably about 100 mm or smaller in view of the obtainable strength of the guide and the ease of guide production. When there is required a guide having a length (L) of 100 mm or larger, it is advisable to provide a plurality of guides each shorter than 100 mm in a chain shape.

When the present guide for a rolling line is provided between the cooling trough and the coil winding machine, it is preferred for easy coiling of the wire rod to provide a plurality of guides each having an axial direction length (L) of desired value, in such a way that they form a gently curved line as a whole. In this case, each two adjacent guides are preferably provided so that the two planes each intersecting one of the two guides at right angles make an angle of larger than 0° but smaller than 30°. When the angle made by the two planes is larger than 30°, the wire rod strongly hits the inner surface of each guide and, in some cases, guides undergo abrasion and damage.

When there is provided, in a curved line as a whole, a guide unit for a rolling line, comprising one metallic housing and a plurality of guide main parts accommodated therein, a gap tends to appear between each guide main part and the housing and, as a result, looseness tends to occur between them.

In such a case, a buffer material is preferably interposed between the guide main parts and the housing. As the buffer material usable, there can be cited, for example, a wire mesh made of a heat-resistant metal (e.g. stainless steel) or a fiber sheet made of a ceramic. A particularly preferable buffer material is a heat-expanding ceramic fiber sheet which shows volume expansion at temperatures of 300° C. or more, for example, Expanding Paper (trade name) of Carborandum Co., for its high stability.

The present invention is described below by Examples and Comparative Examples with reference to the accompanying drawings. However, the present invention is not restricted to these Examples.

FIG. 1 is a sectional view showing an example of the present guide for a rolling line. In FIG. 1, the guide 1 for rolling line has a columnar external shape and consists of a ceramic guide main part 10 having a throughhole consisting of a tapered hole 12 and a straight hole 14.

The end 12*e* of the tapered hole 12 constitutes an inlet. The tapered hole 12 is tapered at a taper angle of θ from the inlet 12*e* toward a transitional portion 13 from the tapered hole 12 to the straight hole 14. Meanwhile, the end 14*e* of the straight hole 14 constitutes an outlet. The straight hole has a constant diameter from the transitional portion 13 to the outlet 14*e*.

A wire rod (not shown in FIG. 1) enters the guide 1 at the inlet 12*e* and leaves the guide 1 from the outlet 14*e*, as shown by an arrow mark A, whereby the wire rod is guided to a desired direction. In this case, even if the direction of the incoming wire rod deviates slightly from the axial direction of the guide 1, i.e. the extension direction of the straight hole 14, or the wire rod is slightly swinging, the wire rod is properly guided by the action of the tapered holed 12.

During the proceeding of the wire rod through the throughhole, the wire rod has a high possibility of contacting with the transitional portion 13. However, the transitional portion 13 can be prevented from damage because the portion is processed so as to have a curved surface of R (radius of curvature). Further, the guide main part 10 has desired properties in Vickers hardness, etc. and accordingly has excellent strength, heat resistance, abrasion resistance, etc.; as a result, as compared with conventional metallic guides, the guide 1 causes little seizure with the wire rod and undergoes little damage.

FIG. 2 shows another example of the present guide. The substantially same members as used in FIG. 1 are endowed with the same numerals in FIG. 2, and no explanation is given to these numerals.

In FIG. 2, the guide 2 for rolling line comprises a ceramic guide main part 10' and a metallic housing 20 accommodating the main part 10'. The guide main part 10' contains a tapered portion 15 for strong connection between the guide main part 10' and the housing 20.

The circumference of the metallic housing 20 can have an engagement portion or a connection portion (not shown in FIG. 2) as necessary. Such a portion makes it easy to provide the guide 2 at a desired site of a rolling line. The housing 20, which is made of a metal, is easy to process and can easily have a connection portion or the like.

Figure 3:
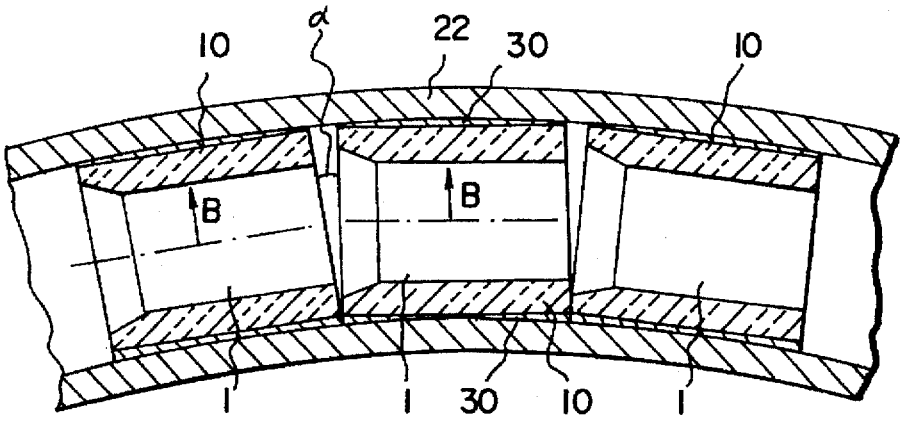
FIG. 3 is a sectional view showing an example of the present guide unit for a rolling line.

FIG. 3 shows an example of a guide unit for a rolling line. In FIG. 3, the metallic housing 22 has a contour of a curved cylinder and accommodates a plurality of guides 1 for a rolling line. The guides 1 are arranged so that a plane B perpendicular to the axial direction of any one guide 1 and a plane B perpendicular to the axial direction of an adjacent guide 1 make an angle (α) larger than 0° but smaller than 30° (said angle α is, when the ends of each guide are perpendicular to its axial direction as in FIG. 3, an angle formed by the outlet side end of any one guide and the inlet side end of an adjacent guide).

A buffer material 30 is filled between the circumference of each guide 1 and the inner surface of the housing 22. It can suppress the swinging, etc. appearing when a wire rod is introduced into the guides. A guide unit as shown in FIG. 3 can preferably be employed between the cooling trough and the coil winding machine of a rolling line.

EXAMPLE 1

A silicon nitride was mixed with 5% by weight of MgO, 5% by weight of $CeO_2$ and 2% by weight of SrO (these are sintering aids) by the use of a mixer. The resulting material was subjected to drying and granulation by the use of a spray dryer. The resulting granules were charged into a mold comprising a die for throughhole formation and a rubber die for external shape formation, and molding was conducted at a pressure of 2.5 t/cm$^2$ by the use of a hydrostatic press.

The molded material obtained was processed by a numerically controlled lathe so as to have a desired shape, then subjected to calcination at 400° C. to remove the binder, and fired at 1,700° C. for 1 hour to obtain a silicon nitride guide as shown in FIG. 1, having an outside diameter of 50 mm, an inside diameter (d) of 30 mm and a length (L) of 60 mm.

A tapered hole 12 was formed before firing, by processing, so as to have a taper angle θ of 15° and a length l of 20 mm. A transitional portion 13 from the tapered hole 12 to the straight hole 14 was formed before firing, by applying a treatment for curved surface, so as to have a radius (R) of curvature of 1 mm.

Five arbitrary points of the inner surface of the above silicon nitride guide were measured for surface roughness by the use of a surface roughness tester. As a result, the maximum height Rmax was 2.5 μm on an average.

PERFORMANCE EVALUATION

To the above-obtained silicon nitride guide was fitted a tool steel housing. 20 of the resulting assemblies were provided in a hot rolling line for iron alloy wire rod, in a transfer section between a rolling mill and a coil winding machine.

A chrome-molybdenum steel was rolled so as to have a final wire diameter of 8 mm and 10,000 tons in total of the steel was rolled. The above guide assemblies were observed after rolling of each about 1,000 tons. As a result, the guide assemblies had no damage and the wire rod after rolling had no abnormalities (e.g. no damage) at the surface.

EXAMPLE 2

A silicon nitride-based molded material was obtained in the same manner as in Example 1 except that the sintering aids were changed to 7% by weight of $Y_2O_3$, 5% by weight of MgO and 1% by weight of $ZrO_2$ and the pressure of the hydrostatic press was changed to 4 t/cm$^2$.

The molded material obtained was processed by a numerically controlled lathe so as to have a desired shape; then subjected to calcination at 450° C. to remove the binder; fired at 1,800° C. for 1 hour; and subjected to a crystallization treatment to obtain a silicon nitride guide having an outside diameter of 50 mm, an inside diameter (d) of 35 mm and a length (L) of 60 mm.

A tapered hole was formed before firing, by the same processing as in Example 1, so as to have a taper angle θ of 20° and a length l of 25 mm. A transitional portion was formed before firing, by applying a treatment for curved surface, so as to have a radius of curvature of 1 mm.

The surface roughness of the inner surface of the above guide was measured in the same manner as in Example 1. As a result, the maximum height Rmax was 3.2 μm on an average.

PERFORMANCE EVALUATION

On the above silicon nitride guide was wound a ceramic fiber sheet as buffer material, i.e. Expanding Paper (trade name) (a product of Carborandum Co.). Six of the thus-formed guides having a ceramic fiber sheet wound thereon were inserted into a curved cylinder-like housing made of a heat-resistant metal, having an inside diameter of 55 mm, an outside diameter of 70 mm and a length of 360 mm. In this case, each two adjacent guides were provided so as to make an angle α (α has been mentioned above) of 10°.

The resulting guide unit having a curved line contour was provided in a hot rolling line for iron alloy wire rod, in a transfer section between a finishing mill and a coil winding machine. A SUS alloy was rolled so as to have a final wire diameter of 5 mm and 20,000 tons in total of the alloy was rolled. As a result, the inner surface of the guide unit had slight abrasion but there was no damage. Further, the wire rod after rolling had no abnormalities at the surface.

COMPARATIVE EXAMPLE

The same performance evaluation as in Example 2 was conducted except that there was used a one-piece guide made of a heat-resistant metal, having an inside diameter of 35 mm, an outside diameter of 70 mm and a length of 360 mm. As a result, damage was seen in the wire rod which passed through the guide, at a timing when 5,000 tons of the SUS alloy was rolled. Rolling was stopped and the inner surface of the guide was observed. As a result, the inner surface had damage which was presumed to be caused by seizure with the wire rod.

As is clear from the above, the guides for a rolling line used in Examples 1 and 2 (these guides fall in the scope of the present invention) are resistant to seizure and have excellent heat resistance, abrasion resistance, etc.

As stated above, in the guide of the present invention, the main part has a throughhole of particular shape and is made of a ceramic; therefore, the present guide, when used in a rolling line, is less liable to cause seizure with a wire rod and has higher durability.

What is claimed is:

1. A guide for wire rod transfer in a rolling line, said guide being comprised of sintered silicon nitride or sialon and having a cylindrical contour and a throughhole for wire rod transfer, said throughhole having an as-fired surface and a surface roughness, $R_{max}$, of 10 μm or less and having a first end and a second end, said throughhole being tapered at said first end so as to gradually decrease from a maximum diameter at said first end to a minimum diameter at a point within said guide, and said throughhole having said minimum diameter from said point to said second end.

2. A guide according to claim 1, wherein the first end is tapered such that a transitional portion from the maximum diameter to the minimum diameter has a radius of curvature of 0.5 mm or more.

3. A guide according to claim 1, wherein the ceramic constituting the guide has a Vickers hardness of 1,100–1,600 at room temperature and 900–1,200 at 800° C. and a bending strength of 500–1,000 Mpa at room temperature to 800° C.

4. A guide according to claim 3, wherein the ceramic has a Vickers hardness of 1,200–1,400 at room temperature and 900–1,200 at 800° C.

5. A guide according to claim 1, which has a metallic housing thereon.

6. A guide unit for a rolling line, comprising (a) a plurality of ceramic guides having a cylindrical contour and a throughhole for wire rod transfer, said throughhole including a tapered hole and a straight hole of constant diameter, said tapered hole being provided at a wire rod inlet side of each guide, and (b) a metallic housing of curved cylindrical contour accommodating the guides, wherein any two adjacent guides are provided so that a plane perpendicular to a central axis of one adjacent guide and a plane perpendicular to a central axis of the other adjacent guide define an angle of larger than 0° but smaller than 30°.

7. A guide unit according to claim 6, wherein a buffer material is filled between outer surfaces of the guides and an inner surface of the metallic housing.

* * * * *